US011608723B2

(12) United States Patent
Al-Qasim et al.

(10) Patent No.: US 11,608,723 B2
(45) Date of Patent: Mar. 21, 2023

(54) STIMULATED WATER INJECTION PROCESSES FOR INJECTIVITY IMPROVEMENT

(71) Applicant: Saudi Arabian Oil Company, Dhahran (SA)

(72) Inventors: Abdulaziz S. Al-Qasim, Dammam (SA); Subhash Chandrabose Ayirala, Dhahran (SA); Majed Almubarak, Dhahran (SA); Abdulrahman Aljedaani, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 269 days.

(21) Appl. No.: 17/140,212

(22) Filed: Jan. 4, 2021

(65) Prior Publication Data

US 2022/0213770 A1 Jul. 7, 2022

(51) Int. Cl.
*E21B 43/20* (2006.01)
*E21B 47/107* (2012.01)

(52) U.S. Cl.
CPC ..... *E21B 43/20* (2013.01); *E21B 47/107* (2020.05)

(58) Field of Classification Search
CPC ..... E21B 43/003
See application file for complete search history.

(56) References Cited

U.S. PATENT DOCUMENTS

| | | | |
|---|---|---|---|
| 1,784,214 | A | 12/1930 | Workman |
| 2,795,279 | A | 6/1957 | Erich |
| 2,799,641 | A | 7/1957 | Gordon |
| 3,417,823 | A | 12/1968 | Faris |
| 3,469,630 | A | 9/1969 | Hurd et al. |

(Continued)

FOREIGN PATENT DOCUMENTS

| | | |
|---|---|---|
| EP | 2596208 | 5/2013 |
| WO | 2014160626 | 10/2014 |
| WO | 2016205158 | 12/2016 |

OTHER PUBLICATIONS

Beresnev et al., "Elastic-wave stimulation of oil production: A review of methods and results." Geophysics 59.6, Jun. 1994, 1000-1017, 18 pages.

(Continued)

*Primary Examiner* — William D Hutton, Jr.
*Assistant Examiner* — Avi T Skaist
(74) *Attorney, Agent, or Firm* — Fish & Richardson P.C.

(57) ABSTRACT

Systems and methods for improving injectivity of a hydrocarbon reservoir include: identifying a restriction of flow from an injection well into the hydrocarbon reservoir; transmitting a series of acoustic waves from an injection well into a formation that includes the hydrocarbon reservoir, wherein the series of acoustic waves are transmitted continuously for at least one day; transmitting a series of seismic waves from the injection well into the formation after the series of acoustic waves are transmitted into the hydrocarbon reservoir, wherein the series of seismic waves are transmitted continuously for at least one week; and injecting water into the injection well to cause hydrocarbon of the hydrocarbon reservoir to flow from the hydrocarbon reservoir to a production well after the series of acoustic waves are transmitted into the hydrocarbon reservoir.

20 Claims, 6 Drawing Sheets

(56) References Cited

U.S. PATENT DOCUMENTS

| | | | | |
|---|---|---|---|---|
| 3,507,330 | A | 4/1970 | Gill | |
| 3,542,066 | A | 11/1970 | Cordova | |
| 3,605,888 | A | 9/1971 | Crowson et al. | |
| 3,724,543 | A | 4/1973 | Bell et al. | |
| 3,782,465 | A | 1/1974 | Bell et al. | |
| 4,296,812 | A | 10/1981 | Kalfoglou | |
| 4,313,500 | A | 2/1982 | Johnson, Jr. et al. | |
| 4,473,114 | A | 9/1984 | Bell et al. | |
| 4,495,990 | A | 1/1985 | Titus et al. | |
| 4,643,256 | A | 2/1987 | Dilgren et al. | |
| 4,982,789 | A | 1/1991 | Prukop | |
| 4,997,044 | A | 3/1991 | Stack | |
| 5,042,297 | A | 8/1991 | Lessi | |
| 5,109,922 | A | 5/1992 | Joseph | |
| 5,517,024 | A | 5/1996 | Mullins et al. | |
| 5,868,030 | A | 2/1999 | Burmley et al. | |
| 6,814,141 | B2 | 11/2004 | Huh et al. | |
| 6,877,556 | B2 | 4/2005 | Wittle et al. | |
| 6,942,043 | B2 | 9/2005 | Kurkoski | |
| 7,077,199 | B2 | 7/2006 | Vinegar et al. | |
| 7,121,342 | B2 | 10/2006 | Vinegar et al. | |
| 7,352,179 | B2 | 4/2008 | Chen et al. | |
| 7,853,045 | B2 | 12/2010 | Touati et al. | |
| 7,866,383 | B2 | 1/2011 | Dusterhoft et al. | |
| 7,980,301 | B1 | 7/2011 | Kostrov et al. | |
| 8,113,278 | B2 * | 2/2012 | DeLaCroix | E21B 43/003 166/177.2 |
| 8,684,076 | B2 | 4/2014 | Kostrov et al. | |
| 8,776,880 | B2 | 7/2014 | Pich et al. | |
| 8,950,495 | B2 | 2/2015 | Barbour et al. | |
| 8,985,206 | B2 | 3/2015 | Morvan et al. | |
| 9,133,709 | B2 | 9/2015 | Huh et al. | |
| 9,212,542 | B2 | 12/2015 | Fripp et al. | |
| 9,284,480 | B2 | 3/2016 | Han et al. | |
| 9,328,597 | B2 | 5/2016 | Morys | |
| 9,394,769 | B2 | 7/2016 | Nenniger | |
| 9,745,833 | B2 | 8/2017 | Carvajal et al. | |
| 9,969,928 | B2 | 5/2018 | He et al. | |
| 10,000,687 | B2 | 6/2018 | Al-Yousef et al. | |
| 10,041,339 | B2 | 8/2018 | Jerauld et al. | |
| 10,107,056 | B2 | 10/2018 | Zhang et al. | |
| 10,184,904 | B1 | 1/2019 | Gong et al. | |
| 10,196,886 | B2 | 2/2019 | Tolman et al. | |
| 10,287,486 | B2 | 5/2019 | Ayirala et al. | |
| 10,563,492 | B2 | 2/2020 | Stokholm et al. | |
| 2002/0035040 | A1 | 3/2002 | Talashek et al. | |
| 2003/0042018 | A1 * | 3/2003 | Huh | E21B 43/003 166/249 |
| 2005/0199387 | A1 | 9/2005 | Wittle et al. | |
| 2009/0110242 | A1 | 4/2009 | Touati et al. | |
| 2010/0044047 | A1 | 2/2010 | Kabishcher et al. | |
| 2011/0306525 | A1 | 12/2011 | Lightheim | |
| 2012/0116443 | A1 | 5/2012 | Ferrera et al. | |
| 2012/0125604 | A1 | 5/2012 | Willingham et al. | |
| 2012/0132416 | A1 * | 5/2012 | Zolezzi-Garreton | E21B 43/003 166/249 |
| 2013/0081459 | A1 | 4/2013 | Merniche | |
| 2013/0274149 | A1 | 10/2013 | Lafitte et al. | |
| 2013/0277046 | A1 | 10/2013 | Haroun et al. | |
| 2014/0039793 | A1 | 2/2014 | Querales | |
| 2014/0216730 | A1 * | 8/2014 | Ersoz | G01V 1/42 166/250.1 |
| 2014/0338903 | A1 | 11/2014 | Mahmoud et al. | |
| 2016/0009981 | A1 | 1/2016 | Teklu et al. | |
| 2016/0061003 | A1 | 3/2016 | Gottumukkala et al. | |
| 2018/0011211 | A1 | 1/2018 | Leonard | |
| 2018/0030816 | A1 | 2/2018 | Devalve et al. | |
| 2018/0253514 | A1 | 9/2018 | Bryant et al. | |
| 2018/0291717 | A1 | 10/2018 | Ayirala et al. | |
| 2018/0328152 | A1 | 11/2018 | Hart et al. | |
| 2018/0347326 | A1 | 12/2018 | Shammari et al. | |
| 2019/0194524 | A1 | 6/2019 | Ayirala et al. | |
| 2020/0392805 | A1 | 12/2020 | Kamler et al. | |

OTHER PUBLICATIONS

PCT International Search Report and Written Opinion in International Appln. No. PCT/US2021/065131, dated Apr. 8, 2022, 16 pages.

Abukhamsin et al., "Inflow profiling and production optimization in smart wells using distributed acoustic and temperature measurements," A dissertation submitted to the Department of Energy Resources Engineering the Committee on Graduate Studies of Stanford University, Jun. 2017, 190 pages.

Al-Anazi et al., "Innovative Production Optimization Technique for Smart Well Completions Using Real-Time Nodal Analysis Applications," SPE-189198-MS, Society of Petroleum Engineers (SPE), presented at the SPE Symposium: Production Enhancement and Cost Optimisation, Nov. 7-8, 2017, 14 pages.

Alghamdi et al., "SmartWater Synergy with Surfactant Chemicals: An Electro-Kinetic Study," SPE-197239-MS, Society of Petroleum Engineers (SPE), presented at the Abu Dhabi International Petroleum Exhibition and Conference, Nov. 11-14, 2019, 12 pages.

Alkandari et al., "Technical Advancement of Carbonate Acid Stimulation Injection," SPE-197982-MS, Society of Petroleum Engineers (SPE), presented at the SPE Kuwait Oil & Gas Conference and Show, Oct. 13-16, 2019, 22 pages.

Alves et al., "Influence of the salinity on the interfacial properties of a Brazilian crude oil-brine systems," Fuel 118: 21-26, Feb. 15, 2014, 6 pages.

Arabzadeh and Amani, "Application of a Novel Ultrasonic Technology to Improve Oil Recovery with an Environmental Viewpoint," Journal of Petroleum and Environmental Biotechnology 08:02, Jan. 2017, 6 pages.

Ayirala et al., "Water ion interactions at crude oil-water interface: A new fundamental understanding of SmartWater flood," SPE 183894-MS, Society of Petroleum Engineers (SPE), presented at the SPE Middle East Oil and Gas Show and Conference, Mar. 6-9, 2017, 17 pages.

Brouwer et al., "Recovery Increase through Water Flooding with Smart Well Technology," SPE 68979, Society of Petroleum Engineers (SPE), presented at the SPE European Formation Damage Conference, May 21-22, 2001, 10 pages.

Bukhamsin et al., "Optimization of multilateral well design and location in a real field using a continuous genetic algorithm," SPE 136944, Society of Petroleum Engineers (SPE), presented at the SPE/DGS Annual Saudi Arabia Section Technical Symposium and Exhibition, Apr. 4-7, 2010, 16 pages.

Cetkovic et al., "A methodology for multilateral wells optimization—field case study," SPE 183004-MS, Society of Petroleum Engineers (SPE), presented at the Abu Dhabi International Petroleum Exhibition & Conference, Nov. 7-10, 2016, 18 pages.

Edabi and Davies, "Techniques for Optimum Placement of Interval Control Valve(s) in an Intelligent Well," SPE 100191, Society of Petroleum Engineers (SPE), presented at the SPE Europec/EAGE Annual Conference and Exhibition, Austria, Jun. 12-15, 2006, 11 pages.

Elmsallati and Davies, "Automatic Optimization of Infinite Variable Control Valves," IPTC-10319, International Petroleum Technology Conferences (IPTC), presented at the International Petroleum Technology Conference, Qatar, Nov. 21-23, 2005, 7 pages.

Farshi, "Improving Genetic Algorithms for Optimum Well Placement," Master's Report, Department of Energy Resources Engineering, Stanford University, California, Jun. 2008, 94 pages.

Flow-industries.com [online], "AirShock Enhanced Oil Recovery," available on or before 2015, [retreived on Nov. 6, 2020], retreived from: URL <https://www.flow-industries.com/oil-and-gas-wells/>, 4 pages.

Ghosh and King, "Optimization of Smart Well Completion Design in the Presence of Uncertainty," SPE 166008, Society of Petroleum Engineers (SPE), presented at the SPE Reservoir Characterization and simulation Conference and Exhibition held in Abu Dhabi, Sep. 16-18, 2013, 17 pages.

Gilev, "Acoustic Well Stimulation of Near-Wellbore Zone for Enhanced Oil Recovery," Center of Ultrasound Technology (CUT Service), 2016, 38 pages.

(56) References Cited

OTHER PUBLICATIONS

Glandt, "Reservoir Aspects of Smart Wells," SPE 81107, Society of Petroleum Engineers (SPE), presented at the SPE Latin America and Caribbean Petroleum Engineering Conference, Trinidad, Apr. 27-30, 2003, 11 pages.
Haupt and Haupt, "Practical Genetic Algorithms," 2nd Edition, John Wiley & Sons, New York, 1-253, 2004, 261 pages.
Holland, "Genetic algorithms," Scientific American, 66-79, Jul. 1992, 14 pages.
Jalali et al., "Intelligent Completion System—The Reservoir Rationale," SPE 50587, Society of Petroleum Engineers (SPE), presented at the SPE European Petroleum Conference, Oct. 20-22, 1998, 6 pages.
Lakatos and Lakatos-Szabo, "Effect of IOR/EOR chemicals on interfacial rheological properties of crude oil/water systems," SPE 65391, Society of Petroleum Engineers (SPE), presented at the 2001 SPE International Symposium on Oilfield Chemistry, Feb. 13-16, 2001, 10 pages.
Liu et al., "Favorable Attributes of Alkaline-Surfactant-Polymer Flooding," SPE 99744, Society of Petroleum Engineers (SPE), presented at the 2006 SPE/DOE Symposium on Improved Oil Recovery, Apr. 22-26, 2006, SPE Journal, Mar. 2008, 12 pages.
Lorenz et al., "Uniform Inflow Completion System Extended Economic Field Life: A Field Case Study and Technology Overview," SPE 101895, Society of Petroleum Engineers (SPE), presented at the SPE Annual Technical Conference and Exhibition, Texas, Sep. 24-27, 2006, 9 pages.
Ma et al., "Adsorption of Cationic and Anionic Surfactants on natural and Synthetic Carbonate Materials," Journal of Colloid and Interface Science, 408:164-172, 2013, 9 pages.
Malkin et al., "Chapter 2: Viscoelasticity," in Rheology: Concepts, Methods, and Applications, 84 pages.
Mitchell, "An Introduction to Genetic Algorithms," Chapter 1-4, Chapter 6, Appendix A-B, MIT Press, 1996, 162 pages.
Mullakaev et al., "Development of Ultrasonic Equipment and Technology for Well Stimulation and Enhanced Oil Recovery," Journal of Petroleum Science and Engineering 125:201-208, 2015, 8 pages.
Naus et al., "Optimization of Commingled Production using Infinitely Variable Inflow Control Valves," SPE 90959, Society of Petroleum Engineers (SPE), presented at the SPE Annual Technical Conference and Exhibition, Texas, Sep. 26-29, 2004, 12 pages.
Pak et al., "Multiscale pore-network representation of heterogeneous carbonate rocks," AGU Publications, Water Resources Research, 52: 5433-5441, 2016, 9 pages.
Qureshi et al., "The Interpretation of Permeability Changes during Acid Injection in Carbonates: A New Integrated Methodology," SPE-177609-MS, Society of Petroleum Engineers (SPE), presented at the Abu Dhabi International Petroleum Exhibition and Conference, Nov. 9-12, 2015, 8 pages.
Radcliff, "Forma Analysis and Random Respectful Recombination," EPCC-TR-91-02, proceedings of 4th International Conference and Genetic Algorithms, San Mateo, CA, 1991, 9 pages.
Rudolph, "Convergence Analysis of Canonic Genetic Algorithms," IEEE Transactions on Neural Networks, Special Issue on Evolutionary Computational 5:1, Jan. 1994, 6 pages.
Sinha et al., "Flow Equilibration Toward Horizontal Well Using Downhole Valves," SPE 68635, Society of Petroleum Engineers (SPE), presented at the SPE Asia Pacific Oil and Gas Conference and Exhibition, Indonesia, Apr. 17-19, 2001, 6 pages.
Tagavifar et al., "Effect of pH on Absorption of Anionic Surfactants on Limestone: Experimental Study and Surface Complexation Modeling," Colloids and Surfaces A: Physiocochemical and Engineering Aspect 538:549-558, Feb. 5, 2018, 10 pages.
Thomas et al., "Alkali and Hybrid-Alkali Flooding as a Tertiary Oil Recovery Mode: Prospects and Challenges," International Journal of Petroleum and Petrochemical Engineering (IJPPE), 2:2 (22-31), 2016, 10 pages.
Wasan et al., "Observations on the coalescence behavior of oil droplets and emulsion stability in enhanced oil recovery," SPE6846, Society of Petroleum Engineers (SPE) of AIME, Dec. 1978, 9 pages.
Westermark et al., "Enhanced Oil Recovery with Downhole Vibration Stimulation," SPE 67303, Society of Petroleum Engineers (SPE), presented at the SPE Production and Operations Symposium, Mar. 24-17, 2001, 13 pages.
Wooden et al., "Seismic Stimulation: An Eco-Friendly, Effective EOR Alternative," Technology Update, JPT, Aug. 2018, 3 pages.
Yeten and Jalali, "Effectiveness of Intelligent Completions in a Multiwell Development," SPE 68077, Society of Petroleum Engineers (SPE), presented at the 2001 SPE Middle East Oil Show, Bahrain, Mar. 17-20, 2017, 7 pages.
Yousef et al., "Laboratory Investigation of the Impact of Injection-Water Salinity and Ionic Content on Oil Recovery For Carbonate Reservoirs," SPE 137634-PA, Society of Petroleum Engineers, Oct. 2011, 14(5): 1-5, 5 pages.
Zhang et al., "Favorable Attributes of Alkali-Surfactant-Polymer Flooding," SPE 99744, Society of Petroleum Engineers (SPE), presented at the 2006 SPE/DOE Symposium on Improved Oil Recovery, Apr. 22-26, 2006, 13 pages.

* cited by examiner

200

| | SCALE | RESERVOIR HETEROGENEITY TYPES | |
|---|---|---|---|
| 208 | GIGA (>300 m) | SEALING TO NONSEALING FAULTS |  |
| | | FRACTURING |  |
| 206 | MEGA (10-100 m) | GENETIC UNIT BOUNDARIES |  |
| | | PERMEABILITY ZONATION WITHIN GENETIC UNITS |  |
| 204 | MACRO (in meters) | BAFFLES WITHIN GENETIC UNITS |  |
| | | SEDIMENTARY STRUCTURES |  |
| 202 | MICRO (μ m) | MICROSCOPIC HETEROGENEITY |  |

STIMULATED WATER INJECTION PROCESSES FOR INJECTIVITY IMPROVEMENT

TECHNICAL FIELD

This disclosure relates to stimulated water injection (SWI) processes for improving injectivity to enhance hydrocarbon recovery.

BACKGROUND

Injectivity is defined as a volume of water injected into a reservoir per unit time (e.g., barrels per day (bbl/d)). Some definitions include dividing this quantity by a pressure differential between an injector well and a production well (e.g., barrels per day per pound per square inch (bbl/d/psi)). In either case, measuring a rate of water injected into the reservoir from the injection well yields an indication of injectivity of the reservoir from that particular injection well. For example, an injection well that injects 2 barrels of water per day has a higher injectivity than an injection well that injects 1 barrel of water per day. Injectivity does not necessarily depend on a production well or an amount of or rate of hydrocarbon recovered from the production well.

Stimulation includes processes to improve the recovery of hydrocarbons (e.g., oil and gas) from a reservoir. Waterflooding, or water injection, is a type of stimulation that uses injected water (e.g., reservoir water, sea water, filtered water, etc.) to push the hydrocarbons toward a production well for recovery. This process also increases the pressure within the reservoir. This is beneficial for hydrocarbon recovery since the pressure within the reservoir tends to decrease over time as the hydrocarbons are extracted.

Water injection also helps to clear blockages around formations that inhibit hydrocarbon flow. These blockages can arise naturally (e.g., reservoir heterogeneity, quality, transmissibility, barriers, faults, scale deposition, etc.) or by human beings (e.g., incompatibility of injection water with reservoir water, use of drilling fluid, fracturing to forcefully move formations, etc.) For example, drilling fluid used during drilling of a well can seep into the nearby formation and cause blockages.

Another type of stimulation is seismic stimulation where low-frequency seismic waves are introduced in the reservoir to remove these blockages. Extracting hydrocarbons when blockages exist typically requires at least one form of stimulation. Improving injectivity is advantageous since it improves stimulation of a reservoir and the ability to recover hydrocarbons from that reservoir.

SUMMARY

The systems and methods described in this disclosure can improve injectivity by combining seismic waves and acoustic waves with water injection to clean regions around a well and for damage removal. Increased injectivity allows for improved recovery of hydrocarbons from the well or from nearby wells.

Formation damage is a problem that affects the productivity of a reservoir. A common cause of formation damage is incompatibility between the injected fluid with the reservoir fluid or between the injected fluid and the formation rock. Formation damage hinders water injection used for pressure maintenance. Increasing pressure could indicate progressive damage that may be attributed to precipitation/ dissolution and scaling. This can cause water blockage, which may be associated with pressure banking at the peripheral injectors.

Pressure banking around the peripheral water injectors can be caused by various factors. For example, reservoir heterogeneities, pore space blockages, permeability damage, and scale deposition, both around the well bore and deep in the reservoir cause pressuring banking. In-situ damage resulting from fine migration and accumulation can also result in poor injectivity, pressure banking at peripheral injectors, and/or poor sweep efficiency. Water blockage can also result from reservoir rock quality and wettability, which may affect relative permeability and trap the water in pores of the formation.

Stimulation using water injection is a one method to clear blockages and increase hydrocarbon recovery. However, simply injecting water into a reservoir may not be sufficient to remove blockages. Situations may arise where the injection water increases the pressure of the reservoir, but does not remove the blockages. Pressure banking can be dangerous if not monitored and can lead to failure of the injection well and/or nearby production wells.

Improving the compatibility of injected fluid (e.g., by water filtering or treatment to remove certain aqueous ions such as sulfates from injection water) is one way to improve injectivity and the recovery of hydrocarbons using water injection. Strategically locating the placement of the injection well is another way to improve the recovery, but sometimes this is difficult to achieve due to cost and/or geographic features (e.g., hills, terrain, etc.).

The systems and methods described in this specification can be used in conjunction with chemical enhanced oil recovery (EOR) processes, water shut off jobs and other sweep efficiency improvement techniques.

Systems for improving injectivity of a hydrocarbon reservoir can include: a first vibration device within an injection well, the first vibration device operable to transmit a series of acoustic waves into a formation around the injection well to improve a flow rate into the formation from the injection well; a second vibration device within the injection well, the second vibration device operable to transmit a series of seismic waves into the formation to improve the flow rate into the formation from the injection well; a pump operable to inject water from the injection well into the formation; and a processor configured to control the first vibration device, the second vibration device, and the pump, the processor: controlling the first vibration device and the second vibration device such that the first vibration device transmits the series of seismic waves after the second vibration device transmits ultrasonic waves; controlling the first vibration device to transmit the series of acoustic waves continuously for at least one week; and controlling the second vibration device to transmit the series of seismic waves continuously for at least one day.

Methods for improving injectivity of a hydrocarbon reservoir can include: identifying a restriction of flow from an injection well into the hydrocarbon reservoir; transmitting a series of acoustic waves from the injection well into a formation that includes the hydrocarbon reservoir, wherein the series of acoustic waves are transmitted continuously for at least one day; transmitting a series of seismic waves from the injection well into the formation after the series of acoustic waves are transmitted into the hydrocarbon reservoir, wherein the series of seismic waves are transmitted continuously for at least one week; and injecting water into the injection well to cause hydrocarbon of the hydrocarbon reservoir to flow from the hydrocarbon reservoir to a production well after the series of acoustic waves are transmitted into the hydrocarbon reservoir.

Embodiments of these systems and methods can include one or more of the following features.

In some embodiments, the first vibration device is operable to vary a frequency of the acoustic waves during the transmission of the acoustic waves.

Some embodiments also include varying a frequency of the acoustic waves during the transmission of the acoustic waves. In some cases, the frequency of the acoustic waves is varied such that the frequency is greater than 20 kHz for a first duration of time and less than 20 kHz for a second duration of time. In some cases, the frequency is dependent on a length scale of a heterogeneity of the formation. In some cases, the frequency is dependent on a predicted distance of the restriction of flow from the injection well.

In some embodiments, the series of acoustic waves include an ultrasonic wave of frequency greater than 20 kHz.

In some embodiments, the second vibration device is operable to vary a frequency of the seismic waves during the transmission of the seismic waves.

Some embodiments also include varying a frequency of the seismic waves during the transmission of the seismic waves. In some cases, the frequency is dependent on a length scale of a heterogeneity of the formation.

In some embodiments, the series of acoustic waves are transmitted continuously for between one day and one week.

In some embodiments, the series of seismic waves are transmitted continuously for between one and four weeks.

Some embodiments also include an injectivity device operable to measure an injectivity of the hydrocarbon reservoir at a production well after injecting the water.

Some embodiments also include measuring an injectivity of the hydrocarbon reservoir at the production well after injecting the water.

In some embodiments, transmitting the series of acoustic waves includes transmitting a second series of acoustic waves into the formation and transmitting the series of seismic waves includes transmitting a second series of seismic waves into the formation. In some cases, the second series of acoustic waves and the second series of seismic waves are transmitted from the injection well. In some cases, the injection well is a first injection well and the second series of acoustic waves and the second series of seismic waves are transmitted from a second injection well into the formation.

The systems and methods described in this specification provide various advantages.

Acoustic waves, including high frequency ultrasonic waves, clear flow restrictions (e.g., blockages) near the injection well while low-frequency seismic weaves clear flow restrictions far from the injection well. By applying the ultrasonic waves before the seismic waves, some flow restrictions are removed so the seismic waves are more effective at clearing flow restrictions far from the injection well.

By applying a sequential application in long durations (e.g., applying acoustic waves for 1-day to 1 week followed by seismic waves for 1 week to 4 weeks), flow restrictions are removed or cleared over time. By incorporating processor logic to activate vibration devices (and control wave frequency and intensity) when needed, the stimulation process is efficient.

Injectivity is improved without the need for acid based injection well stimulation technologies, which are less environmentally friendly. The improved injectivity is also beneficial upstream of a reservoir by enhanced sweep efficiency and less water handling, which contribute to a lower carbon footprint.

The details of one or more implementations of these systems and methods are set forth in the accompanying drawings and the description below. Other features, objects, and advantages of these systems and methods will be apparent from the description and drawings, and from the claims.

DESCRIPTION OF DRAWINGS

Like reference symbols in the various drawings indicate like elements.

DETAILED DESCRIPTION

The systems and methods described in this disclosure can improve injectivity by combining seismic waves and acoustic waves with water injection to clean regions around a well and to remove damage. Increased injectivity allows for improved recovery of hydrocarbons from the well or from nearby wells.

Figure 1:
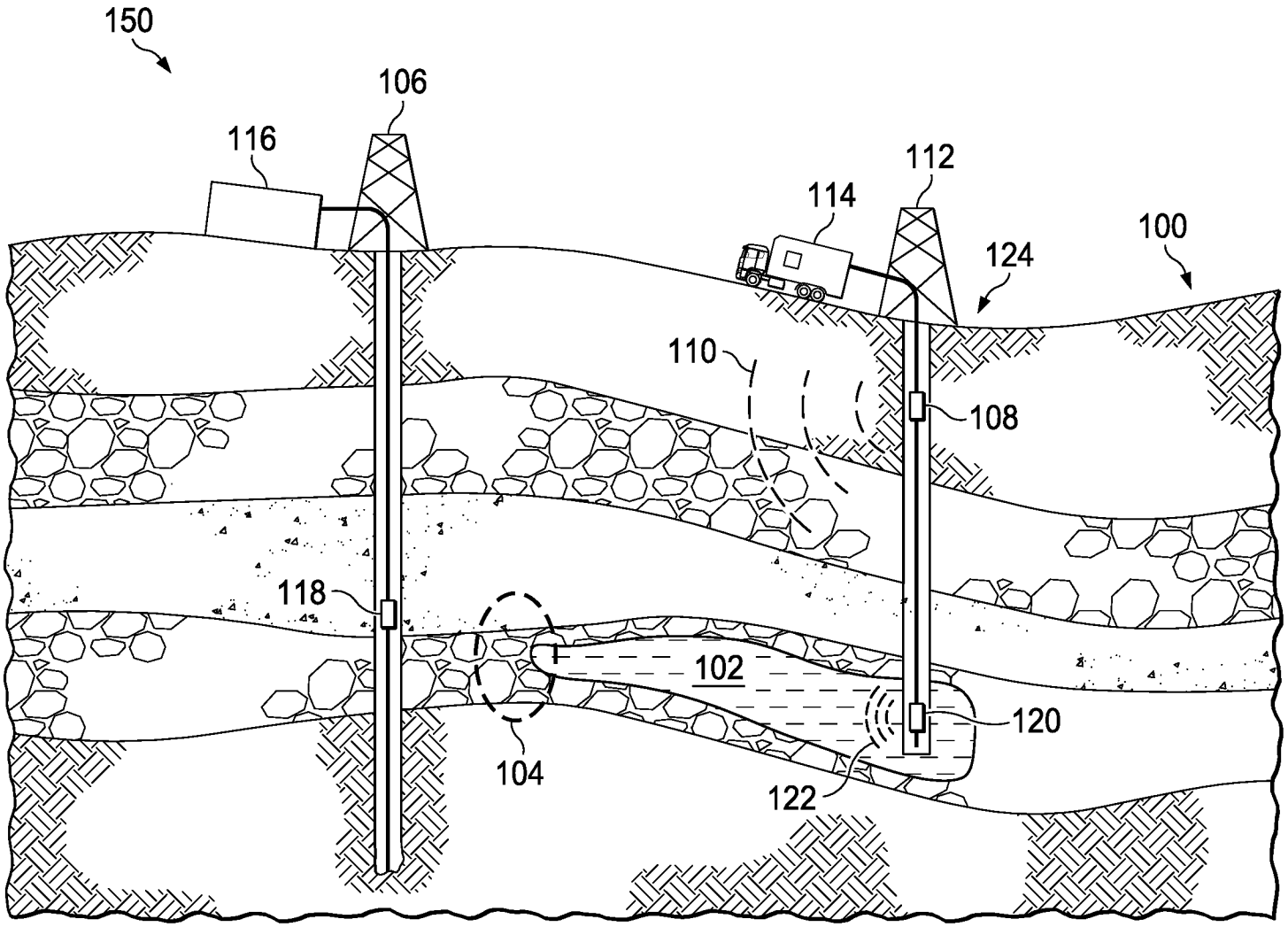
FIG. 1 is an illustration of water blockage in a reservoir.

FIG. 1 is an illustration of a subterranean formation 100 that includes a hydrocarbon reservoir 102 with a blockage 104 that represents a source of flow restriction. The blockage 104 at least partially restricts a flow of hydrocarbon out of the reservoir 102 (e.g., from flowing to a production well 106). A vibration device 108 of an injectivity system 150 is configured to transmit low-frequency seismic waves 110 from an injection well 112 to the location of the blockage 104.

The seismic waves 110 typically range in frequency from 10 Hz to 1 kHz and are transmitted with a power of 1 mW to 10 mW. The seismic waves 110 are periodic high energy shock waves that travel as elastic waves (i.e., seismic P and S waves) deep into the formation 100 and the reservoir 102 (on the order of kilometers). In some implementations, the low seismic waves 110 travel a distance around the injection well 112 with a 2-3 km radius.

The seismic waves 110 loosen part of the formation 100 surrounding the blockage 104 to unblock the blockages 104, mobilize the confined/trapped injected water from the injection well 112. This improves the fluid path between the injection well 112 and a production well 106 and improves the flow of hydrocarbon from the reservoir 102 to the production well 106 for hydrocarbon recovery.

The vibration device 108 is configured to continuously transmit the seismic waves 110 for a duration of at least one week, at least four weeks, or for up to a year. A truck 114 of the injectivity system 150 provides a power source to power the vibration device 108 during this period. The truck 114 also includes processors and data electronics to transmit and receive data and signals to the vibration device 108. In some implementations, the truck 114 and or the vibration device 108 transmits and receives information over a cellular network to and from the processor 116 of the production well 106. The information includes data and control instructions. In some implementations, an operator controls the vibration device 108 manually.

Both linear and non-linear seismic waves 110 are transmittable by the vibration device 108. For example, a low-amplitude seismic wave 110 corresponds to a linear seismic wave 110 while a large amplitude seismic wave 110 corresponds to a non-linear shock wave. Varying between linear and non-linear seismic waves 110 is controllable by a processor of the truck 114 using an intensity of desired the seismic wave 110. Intensity corresponds to a power level and an amplitude of the seismic wave 110.

The intensity of the seismic waves 110 is determined based on the parameters such as permeability, and pressure gradients to result in optimal vibration conditions. In some implementations, the intensity ranges between 0.1 g to 10 g (unit of gravity). For example, if the permeability of the formation 100 is low, the intensity of the seismic wave 110 is increased by the vibration device 108 so that there is a higher likelihood that the seismic wave 110 reaches the blockage 104. On the other hand, if the permeability of the formation 100 is high, the intensity of the seismic wave 110 is decreased by the vibration device 108 to conserve energy. In some implementations, the intensity of the seismic wave 110 is controlled, by the processor of the truck 114, to begin with low intensity (e.g., 0.1 g) and gradually increase to high intensity (e.g., 10 g). In some implementations, the intensity of the seismic waves 110 are varied or cycled during the transmission.

A flow meter 118 of the production well 106 is configured to transmit a signal to the processor 116 that is proportional to the flow and/or flow rate of hydrocarbons recovered from the production well 106. In some implementations, the processor 116 determines when to turn on the vibration device 108 based on when an injection value is below a threshold and communicates this to truck 114 so the acoustic device 108 is turned on. In some implementations, the flow meter 118 is a downhole multi-phase flowmeter. In some implementations, the flow meter 118 is a surface multi-phase flowmeter. In some implementations, the flow meter 118 combines the features of both a downhole multi-phase flowmeter and a surface multi-phase flowmeter.

A depth of the vibration device 108 is shown to be partially down the injection well 112, but in some implementations, the depth is near the bottom of the injection well 112. In other implementations, the vibration device 108 is located on the ground surface 124. In some implementations, the vibration device 108 is permanently installed. In some implementations, the vibration device 108 is mobile and deployed when needed.

A second vibration device 120 is configured to transmit acoustic waves 122 from the injection well 112 to the location of the blockage 104. In particular, acoustic waves 122 in an ultrasonic range (e.g., 20 kHz+) are able to destroy mineral scale and waxing when dispersed in porous media to remove the blockage 104.

The acoustic waves typically range in frequency from 0.1 Hz up to 20 kHz but this is not restrictive. The ultrasonic waves typically range in frequency from 20 kHz up to 100 kHz but this is also not restrictive. In some implementations, ultrasonic waves up to 2 GHz are used. The acoustic waves 122 travel as pressure waves through the reservoir 102 and loosen part of the formation 100 surrounding the blockage 104 so that the reservoir 102 can flow to the production well 106. High frequency ultrasonic waves clear blockages near the vibration device 120 (e.g., on the order of meters).

Both linear and non-linear acoustic waves 122 are transmittable by the vibration device 120. Varying between linear and non-linear acoustic waves 122 is controllable by the processor of the truck 114 using an intensity of a desired the acoustic wave 112. The vibration device 120 is configured to transmit the acoustic waves 122 continuously for a duration of at least one day, at least one week, or for at least multiple weeks.

In the injectivity system 150, acoustic waves 122 are generated by the vibration device 120 in the reservoir 102 directly. In some implementations, the acoustic waves 122 travel through formation before reaching the reservoir 102.

In the injectivity system 150, the vibration device 120 is located near the bottom of the injection well 112. In some implementations, the vibration device 120 is located closer to the top of the injection well 112. In some implementations, the vibration device 120 is located on the ground surface 124.

In some implementations, the second vibration device 120 is configured to inject nano-fluids and tracers (e.g., water tracers, encapsulated nanoparticles, other nano-fluids, etc.) into the formation 100 or reservoir 102 to improve injectivity or to assess the effectiveness of the deployed stimulation technologies. In some implications, nano-fluids and tracers are injected shortly before the transmission of the acoustic and/or seismic waves. This gives the nano-fluids and tracers time to propagate into the formation. In some cases, the nano-fluids and tracers enable data to be acquired that better represents the stimulation effectiveness. For example, in some implementations, one or more monitoring devices located at the production well 106 and/or injection well 112 measure the presence of the nano-fluids and tracers and this measurement is used an indication of how well the stimulation is being performed.

The injection well 112 is also configured to pump injection water into the injection well 112 to stimulate the reservoir and improve hydrocarbon recovery. A pump that pumps in the injection water is also in communication with the processors within the truck 114. This allows the truck 116 to not only determine when to activate/deactivate the vibration devices 108, 120, but also when to activate/deactivate the flow of injection water into the injection well 112.

In the injectivity system 150, one injection well 112 is used. In some implementations, more than one injection well (e.g., 10 injection wells) are strategically placed around the production well 106 and are each in communication with the processor of the truck 116. In some implementations, vibration devices 108, 120 are installed in one or more injection wells around a reservoir 102 to increase the amount of seismic and acoustic energy that reaches the blockages 104.

In some implementations, a beam-steering technique is used to focus energy to an expected blockage location. For example, three injection wells 112 arranged in a 120 degree triangle around a reservoir 102 are configured to focus energy in the reservoir 102. In this scenario, each of the three injection wells 112, transmit seismic waves 110 and acoustic waves 112 and they superimpose to cause the largest effect where the waves intersect. In this arrangement, the intersection is in the reservoir 102.

In some implementations, more than one injection well 112 is used in association with more than one production well 106. In some implementations, an abandoned well is used as the injection well.

In the injectivity system 150, one vibration device 108 and one vibration device 120 is used. In some implementations, more than one vibration devices 108, 120 are used to increase the energy of seismic and/or acoustic energy that reaches the blockage 104.

Determining which type of stimulation (e.g., seismic waves 110, acoustic waves 112, and/or injected water) is to be used depends on the heterogeneities present within the formation. In some implementations, the acoustic waves 112 are used when the injectivity impairment is due to near wellbore damage. In some implementations, seismic waves are used when the injectivity impairment is caused by the blockage of pore throats deep in the reservoir. In some implementations, water is injected when no injectivity issues are detected.

For example, if the processor knows that very large formation heterogeneities such as non-sealing faults are affecting the injectivity, then the processor can activate seismic waves 110 since the wavelengths of the seismic waves 100 may have a comparable scales to the formation heterogeneity. On the other hand, if the if the processor knows that very small formation heterogeneities such as microscopic heterogeneities or sedimentary structures are affecting the injectivity, then the processor can activate acoustic waves 122 since the wavelengths of the acoustic waves 122 may have a comparable scales to the formation heterogeneity.

Figure 2:
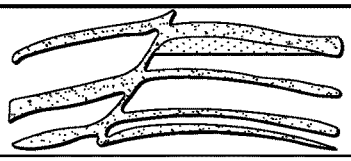
FIG. 2 is a classification of reservoir heterogeneities.
Figure 2:
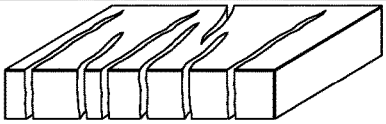
Figure 2:
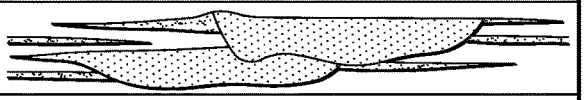
Figure 2:
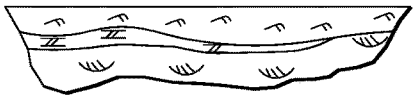
Figure 2:
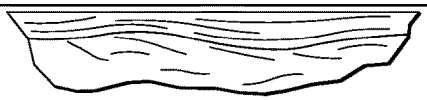
Figure 2:
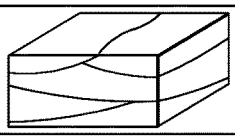
Figure 2:
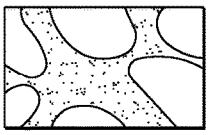

FIG. 2 is a classification of reservoir heterogeneity types 200. Microscopic heterogeneities 202 are on the order of micrometer (μm) and are particular responsive (e.g., excited, resonated) by waves of comparable wavelength. For example, an ultrasonic wave 122 with a wavelength on the order of micrometer (μm) can be used to clear blockages in microscopic heterogeneities 202.

Macroscopic heterogeneities 204 are found in sedimentary structures and baffles within genetic units. Macroscopic heterogeneities 204 are on the order of meters (m) and are also particular responsive to these wavelengths. For example, an acoustic wave 122 with a wavelength on the order of meters can be used to clear blockages in macroscopic heterogeneities 204.

Reservoir heterogeneities also include megascopic heterogeneities 206 of permeability zonation within genetic units and genetic unit boundaries and gigascopic heterogeneities 208 of fracturing and sealing to non-sealing faults. These scales are particular responsive to long wavelengths such as seismic waves 110 which travel very far (e.g., a 2-3 km radius around the injection well 112).

These stimulation methods can be improved by employing them either sequentially or simultaneously. For example, while seismic waves 110 are particularly effective for gigascopic heterogeneities 208 such as non-sealing faults, microscopic heterogeneities may also be present near the injection well 112. By performing seismic wave 110 and acoustic wave 122 stimulation together, injectivity is improved. In these cases, lower-frequency seismic waves 110 has a very long wavelength and is used to resolve causes of pressure banking far from the injection well 112 (e.g., on the order of kilometers), while higher-frequency acoustic waves 122 resolve causes of pressure banking near the injection well 112 (e.g., on the order of meters).

For example, vibrations associated at high frequency ultrasonic waves 112 are useful for cleaning near the injection well 112 and to remove blockages near the injection well 112. After removing blockages near the injection well 112, the high energy seismic waves 110 travel deeper into reservoir 102 to remove blockages 104 at longer distances away from the wellbore. Collectively, this improves the sweep and fluid flow between the injection well 112 and the production well 106.

Figure 3:
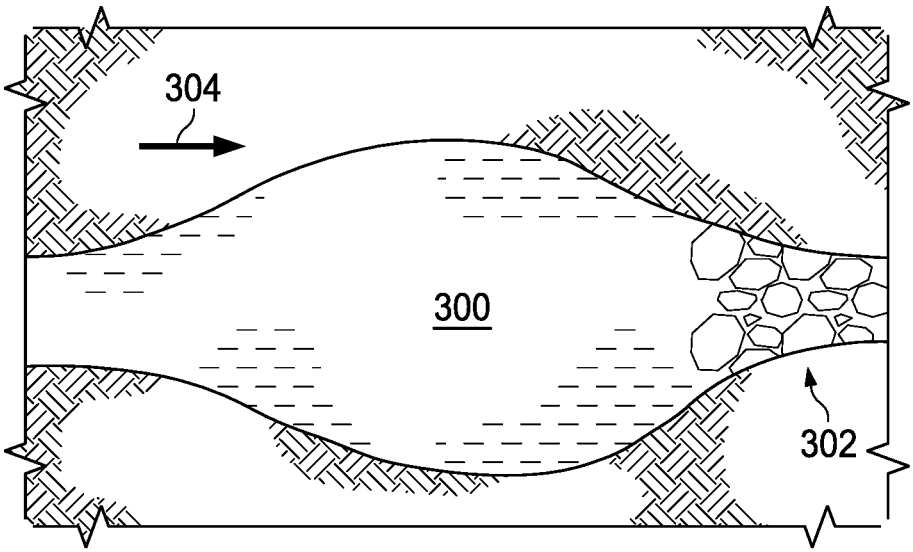
FIG. 3 is an illustration of water blockage due to in-situ damage.

FIG. 3 illustrates a reservoir 300 with a blockage 302. The blockage 302 inhibits the flow of the reservoir 300 in a direction of arrow 304. Pumping of additional injection water from the left side of the reservoir 300 does not resolve the blockage 302. However, by transmitting seismic waves 110 and acoustic waves 122 to the blockage 302, the blockage can be cleared to the reservoir 300 can flow in the direction of the arrow 304.

Figure 4:
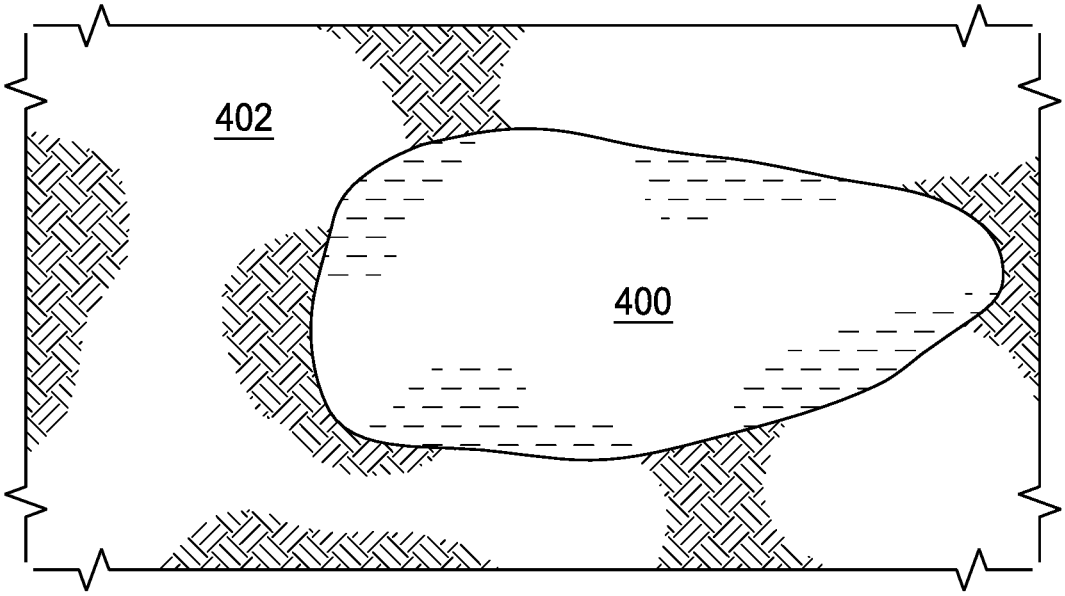
FIG. 4 is an illustration of water blockage within the pores of a formation.

FIG. 4 illustrates a reservoir 400 trapped within the pores of a formation 402. Water blockage can also result from reservoir rock quality and wettability, which may affect relative permeability and trap the water in pores as shown in FIG. 4. In some cases, injectivity of a trapped reservoir 400 is completely stopped. In this case, transmitting seismic waves 110 and acoustic waves 122 to area of the reservoir 400 causes one or more fluid paths to the reservoir 400 to open so that the reservoir 300 can flow.

Figure 5A:
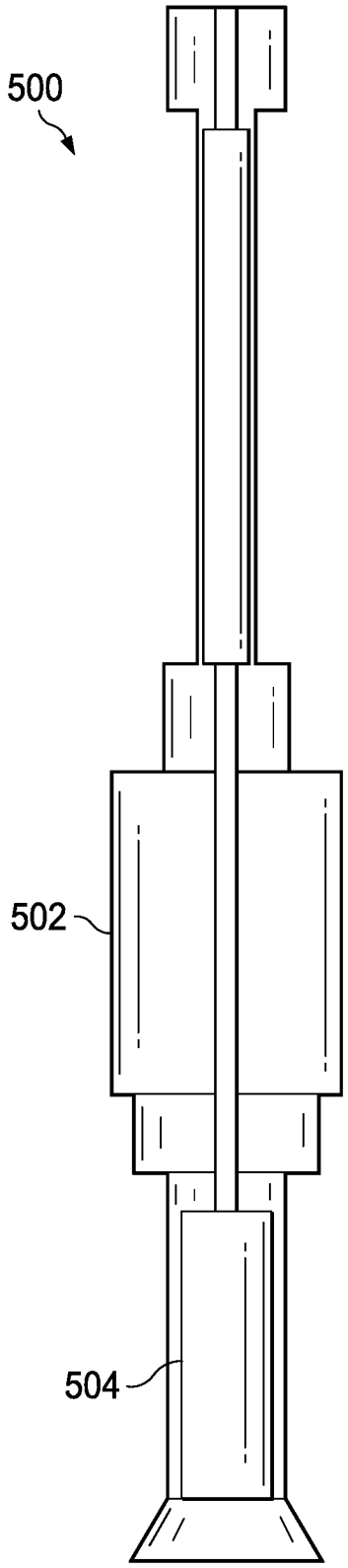
FIGS. 5A and 5B are renderings of a device for creating shockwaves.
Figure 5B:
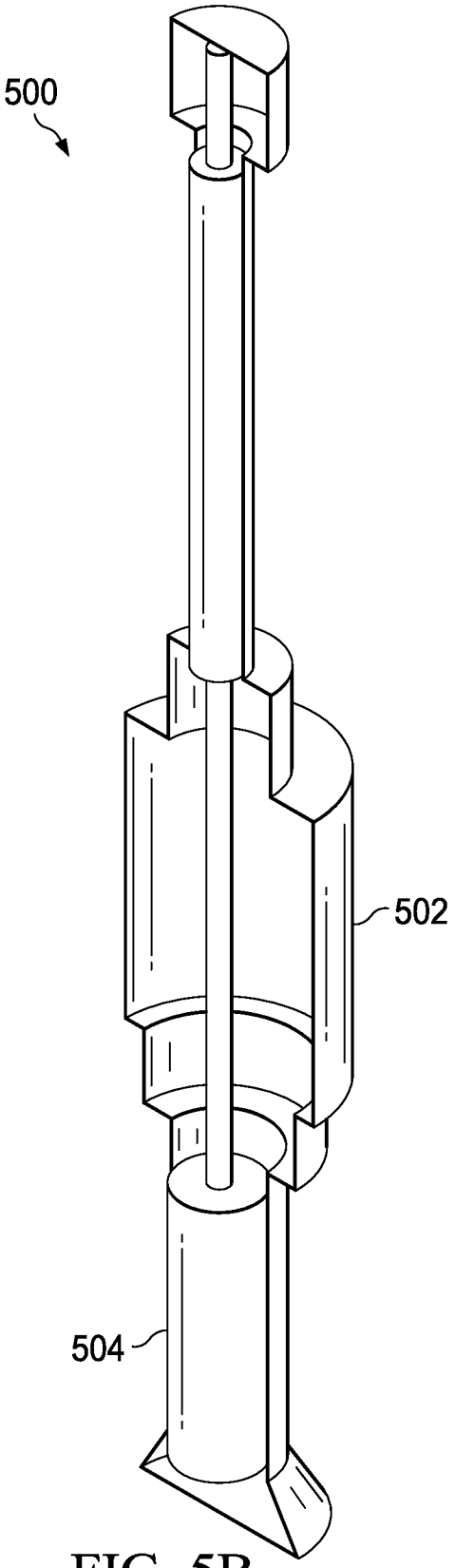

FIGS. 5A and 5B are renderings of a sucker rod pump 500 for vertical water injectors. However, in some implementations, the water injector is configured horizontally. In some implementations, the sucker rod pump 500 includes the functionality of the vibration device 108 and vibration device 120 described with respect to FIG. 1. The sucker rod pump 500 is typically installed in the injection well 112 or on the ground surface 124 near the injection well 112. The sucker rod pump 500 is configured to deliver transient pressure pulses and/or oscillatory waves (e.g., the seismic 110 and acoustic waves 122).

The sucker rod pump 500 includes a housing 502 and a plunger 504 that is slidably movable within the housing 502. A processor of the water injector controls a servo-pneumatic actuation to slide the plunger 504 in one direction to create a negative pressure in the injection well 112 (e.g., by retracting the plunger 204 within the housing 502, a vacuum is created). The processor also controls the servo-pneumatic actuation to slide the plunger 504 in a second direction to create a positive pressure in the injection well 112 (e.g., by retracting the plunger 204 within the housing 502, the injection well 112 is pressurized). This process is repeated with various acceleration profiles to generate transient and steady-state waves in the formation 100 in and around the reservoir 102.

Figure 6:
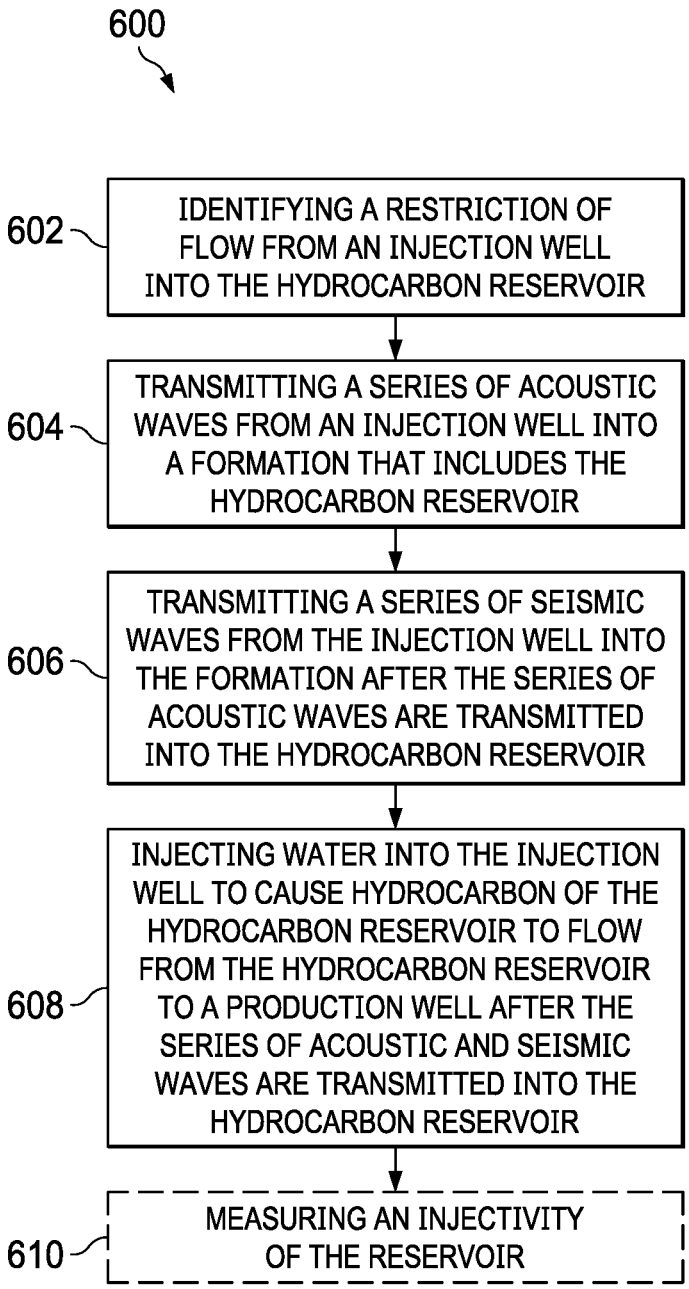
FIG. 6 is a flow chart of a method of an injectivity system.

FIG. 6 is a flowchart of a method 600 to improve injectivity of a hydrocarbon reservoir 102. A restriction of flow is identified 602 from an injection well 112 into the hydrocarbon reservoir 102.

A series of acoustic waves is transmitted 604 from the injection well 112 into a formation that includes the hydrocarbon reservoir. In some implementations, the series of acoustic waves are transmitted continuously for at least one day. A first vibration device transmits the acoustic waves. Preferably, the transmitted acoustic waves travel to the restriction of flow surrounding the reservoir 102 that at least partially restricts the flow of hydrocarbon out of the hydrocarbon reservoir 102. In some implementations, the ultrasonic wave is transmitted continuously for a duration of at least one day or at least one week. In some implementations, the series of acoustic waves are transmitted continuously for between one day and one week. In some implementations, the series of acoustic waves are transmitted continuously for greater than one week.

A series of seismic waves is transmitted 606 from the injection well 112 into the formation after the series of acoustic waves are transmitted into the hydrocarbon reservoir. In some implementations, the series of seismic waves are transmitted continuously for at least one week. A second vibration device transmits the seismic waves. Preferably, the transmitted seismic waves travel to the restriction of flow surrounding the reservoir 102 and a combination of the transmitted ultrasonic waves and the transmitted seismic waves cause the flow through the at least one source of the flow restriction to be increased. In some implementations, the series of seismic waves are transmitted continuously for between one and four weeks. In some implementations, the series of seismic waves are transmitted continuously for more than four weeks.

Water is injected 608 into the injection well 112 to cause hydrocarbon of the hydrocarbon reservoir to flow from the hydrocarbon reservoir to a production well after the series of acoustic and seismic waves are transmitted into the hydrocarbon reservoir. A pump pumps the water. In some implementations, the water is reservoir water. In some implementations, water is injected for a duration of at least one year. In some implementations, water is injected through the restriction of flow.

For example, in some implementations, a sequential application of high frequency ultrasound waves (e.g., 1-day to 1 week) followed by low frequency seismic based elastic waves (e.g., 1 week to 4 weeks) is applied to the formation 100 to clear one or more blockages 104 or sources of flow restriction of the reservoir 102. Water is injected 608 after this process to increase injectivity. This process is repeated as needed.

In some implementations, an injectivity of the hydrocarbon reservoir is measured 610 at the production well after injecting the water.

In some implementations, a frequency of the acoustic waves is varied during the transmission of the acoustic waves. For example, in some implementations, the frequency of the acoustic waves is varied such that the frequency is greater than 20 kHz for a first duration of time and less than 20 kHz for a second duration of time.

In some implementations, the frequency is dependent on a length scale of a heterogeneity of the formation. For example, knowing that the heterogeneity of the formation is short (e.g., on the other of micrometers such as the microscopic heterogeneities 202 described with respect to FIG. 2 above), the system can vary the frequency to transmit ultrasonic waves. Knowing that the heterogeneity of the formation is long (e.g., on the other of hundreds of meters such as the gigascopic heterogeneities 208), the system can vary the frequency to transmit low frequency acoustic waves.

In some implementations, the frequency is dependent on a predicted distance of the restriction of flow from the injection well 112. For example, knowing that the restriction of flow is close to the injection well 112, ultrasonic waves are used to target restriction of flow.

In some implementations, a frequency of the seismic waves is varied during the transmission of the seismic waves.

In some implementations, a second series of acoustic waves and/or seismic waves is transmitted into the formation. In some implementations, the second series of acoustic waves and the second series of seismic waves are transmitted from the injection well 112. In some implementations, the second series of seismic waves are transmitted from a second injection well into the formation.

In some implementations, processors and/or a remote server in communication with the processors are configured to perform the actions of the method 600. For example, processors within the truck 114 at the injection well 112 or processors at the production well 106 perform the actions of method 600.

In some implementations, the processor controls the first vibration device 108 and the second vibration device 120 to transmit waves in response to receiving a signal that a restriction of flow is present. In some implementations, the at least one signal is received by a flow sensor 118 associated with a production well 106. In scenarios where more than one injection well 112 is used, the processor is configured to individually instruct each of the vibration devices associated with respective injection wells 112 to transmit respective waves using particular frequencies and intensities. In this way, the processor can effectively steer the waves such that an area defined by the superposition of these waves is directed to the restriction of flow.

In some implementations, method 600 is periodically repeated on a yearly basis. In some implementations, the repetition of the method 600 regains lost (or decreased) injectivity from fine migration, scale formation, and pressure banking from a previous water injection 606. In some implementations, transmitting 602 the acoustic waves and transmitting 604 the seismic waves occur substantially simultaneously with the water injection 606.

Figure 7:
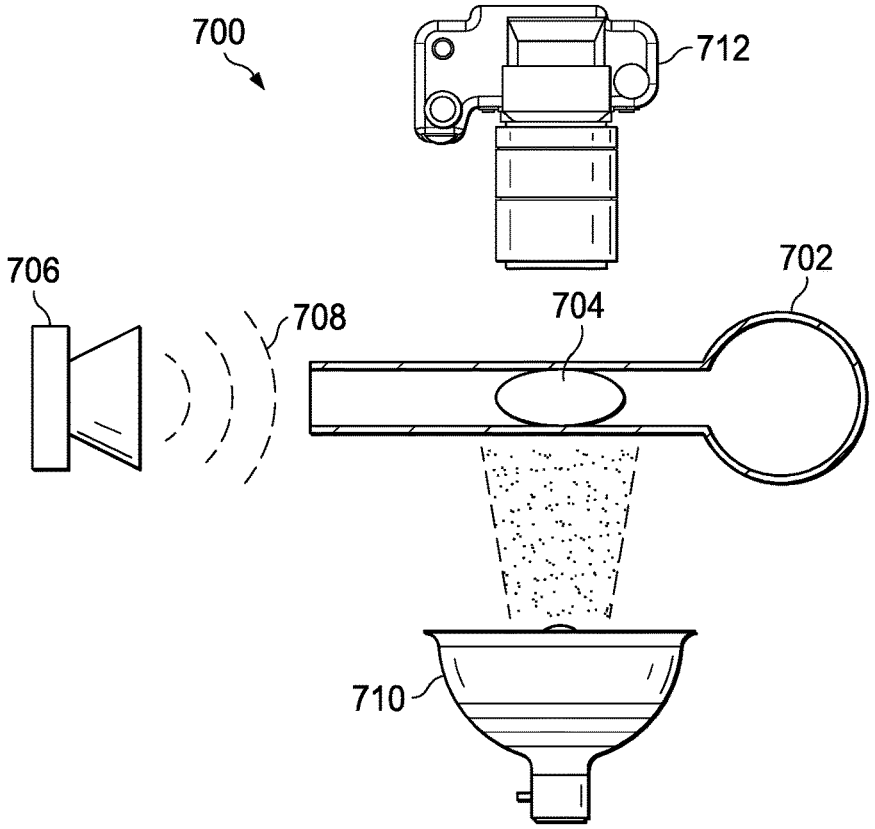
FIG. 7 is a schematic of an experimental setup.

FIG. 7 is a schematic of an experimental setup 700 to measure improved injectivity. A bubble 704 represents a blockage in a reservoir. A microfluidics chamber 702 is sized to represent the reservoir. A vibration source 706 is used to transmit waves 708 to the blockage 704. The vibration source 706 is configured to transmit shear and longitudinal elastic waves (representing seismic waves) through the housing of the microfluidics chamber 702. The vibration source 706 is also configured to transmit high frequency acoustic waves through a fluid of the microfluidics chamber 702. The fluid within the microfluidics chamber 702 represents hydrocarbon in the reservoir and is simulated as water, oil, or another viscous fluid.

A length and a geometry of the microfluidics chamber 702 is sized with respect to the blockage 704 and the vibration source 708 to test various forms of blockages found in a formation. An angle (not shown) of the microfluidics chamber 702 allows the fluid to flow under the influence of gravity out of the microfluidics chamber 702. In some implementations, a steeper angle corresponds to a higher pressure of injection well water and a shallower angle corresponds to a lower pressure of injection well water. The experimental setup 700 measures test parameters such as viscosity, surface tension, roughness, pressure, and temperature.

A light source 710 illuminates the blockage 704 and the fluid around the blockage 704 so that a camera 712 has sufficient lighting to image the blockage 704. The images of the camera 712 are used to determine how well the fluid flows through the blockage (i.e., dynamic behavior). In some implementations, the camera 712 is a high speed camera capable of more than 1,000 frames per second. Processing of the one or more images versus a time of the image determines the flow rate of the blockage. In some implementations, the one or more images are used to determine an effect of surface tension, viscosity, and velocity of the flow. A non-dimensional relationship is identified that correlates these test parameters so that an injectivity improvement of larger scales (e.g., on the order of formation 100) is predicted.

By varying the types of stimulation used (wave type, wave frequency, wave amplitude, injection well pressure), with respect to the size and properties (e.g., surface roughness) of the blockage 704, the length and geometry of the microfluidics chamber 702, and the viscosity of the fluid within the microfluidics chamber 702, the one or more images from the camera 712 yields quantitative and qualitative information based on an injectivity improvement.

In some implementations, a high temperature and a high pressure is applied to the microfluidics chamber 702 during the experiment to represent reservoir conditions within the formation 100.

Figure 8:
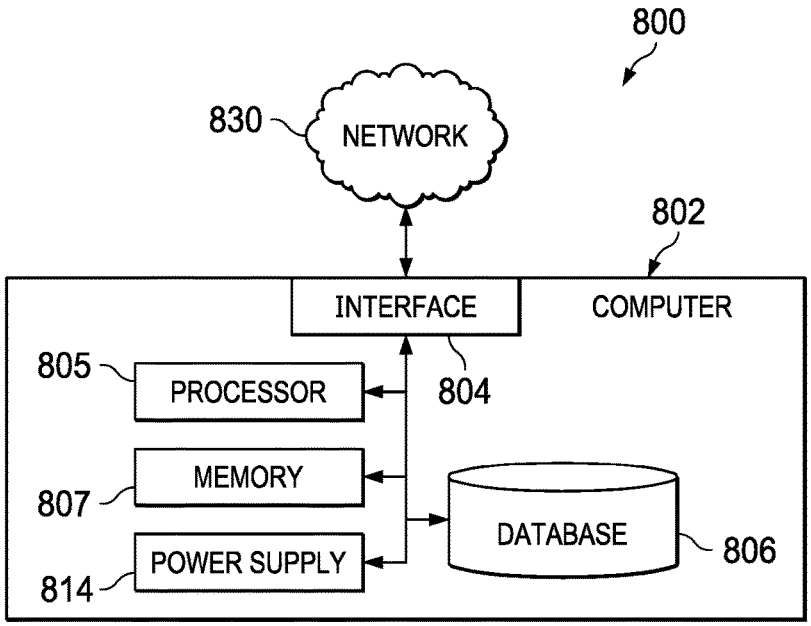
FIG. 8 is a block diagram of a computer system.

FIG. 8 is a block diagram of an example computer system 800 that can be used to provide computational functionalities associated with described algorithms, methods, functions, processes, flows, and procedures described in the present disclosure. In some implementations, the computer system 800 performs the function of the vibration devices 108, 120, and the processors within the trucks 114, 116 described with respect to FIG. 1. In some implementations, the computer system 800 performs the function the processors of the experimental setup 600 described with respect to FIG. 6.

The illustrated computer 802 is intended to encompass any computing device such as a server, a desktop computer, an embedded computer, a laptop/notebook computer, a wireless data port, a smart phone, a personal data assistant (PDA), a tablet computing device, or one or more processors within these devices, including physical instances, virtual instances, or both. The computer 802 can include input devices such as keypads, keyboards, and touch screens that can accept user information. Also, the computer 802 can include output devices that can convey information associated with the operation of the computer 802. The information can include digital data, visual data, audio information, or a combination of information. The information can be presented in a graphical user interface (UI) (or GUI). In some implementations, the inputs and outputs include display ports (such as DVI-I+2× display ports), USB 3.0, GbE ports, isolated DI/O, SATA-III (6.0 Gb/s) ports, mPCIe slots, a combination of these, or other ports. In instances of an edge gateway, the computer 802 can include a Smart Embedded Management Agent (SEMA), such as a built-in ADLINK SEMA 2.2, and a video sync technology, such as Quick Sync Video technology supported by ADLINK MSDK+. In some examples, the computer 802 can include the MXE-5400 Series processor-based fanless embedded computer by ADLINK, though the computer 802 can take other forms or include other components.

The computer 802 can serve in a role as a client, a network component, a server, a database, a persistency, or components of a computer system for performing the subject matter described in the present disclosure. The illustrated computer 802 is communicably coupled with a network 830. In some implementations, one or more components of the computer 802 can be configured to operate within different environments, including cloud-computing-based environments, local environments, global environments, and combinations of environments.

At a high level, the computer 802 is an electronic computing device operable to receive, transmit, process, store, and manage data and information associated with the described subject matter. According to some implementations, the computer 802 can also include, or be communicably coupled with, an application server, an email server, a web server, a caching server, a streaming data server, or a combination of servers.

The computer 802 can receive requests over network 830 from a client application (for example, executing on another computer 802). The computer 802 can respond to the received requests by processing the received requests using software applications. Requests can also be sent to the computer 802 from internal users (for example, from a command console), external (or third) parties, automated applications, entities, individuals, systems, and computers.

Each of the components of the computer 802 can communicate using a system bus. In some implementations, any or all of the components of the computer 802, including hardware or software components, can interface with each other or the interface 804 (or a combination of both), over the system bus. Interfaces can use an application programming interface (API), a service layer, or a combination of the API and service layer. The API can include specifications for routines, data structures, and object classes. The API can be either computer-language independent or dependent. The API can refer to a complete interface, a single function, or a set of APIs.

The service layer can provide software services to the computer 802 and other components (whether illustrated or not) that are communicably coupled to the computer 802. The functionality of the computer 802 can be accessible for all service consumers using this service layer. Software services, such as those provided by the service layer, can provide reusable, defined functionalities through a defined interface. For example, the interface can be software written in JAVA, C++, or a language providing data in extensible markup language (XML) format. While illustrated as an integrated component of the computer 802, in alternative implementations, the API or the service layer can be standalone components in relation to other components of the computer 802 and other components communicably coupled to the computer 802. Moreover, any or all parts of the API or the service layer can be implemented as child or submodules of another software module, enterprise application, or hardware module without departing from the scope of the present disclosure.

The computer 802 can include an interface 804. Although illustrated as a single interface 804 in FIG. 8, two or more interfaces 804 can be used according to particular needs, desires, or particular implementations of the computer 802 and the described functionality. The interface 804 can be used by the computer 802 for communicating with other systems that are connected to the network 830 (whether illustrated or not) in a distributed environment. Generally, the interface 804 can include, or be implemented using, logic encoded in software or hardware (or a combination of software and hardware) operable to communicate with the network 830. More specifically, the interface 804 can include software supporting one or more communication protocols associated with communications. As such, the network 830 or the interface's hardware can be operable to communicate physical signals within and outside of the illustrated computer 802.

The computer 802 includes a processor 805. Although illustrated as a single processor 805 in FIG. 8, two or more processors 805 can be used according to particular needs, desires, or particular implementations of the computer 802 and the described functionality. Generally, the processor 805 can execute instructions and can manipulate data to perform the operations of the computer 802, including operations using algorithms, methods, functions, processes, flows, and procedures as described in the present disclosure.

The computer 802 can also include a database 806 that can hold data for the computer 802 and other components connected to the network 830 (whether illustrated or not). For example, database 806 can be an in-memory, conventional, or a database storing data consistent with the present disclosure. In some implementations, database 806 can be a combination of two or more different database types (for example, hybrid in-memory and conventional databases) according to particular needs, desires, or particular implementations of the computer 802 and the described functionality. Although illustrated as a single database 806 in FIG. 8, two or more databases (of the same, different, or combination of types) can be used according to particular needs, desires, or particular implementations of the computer 802 and the described functionality. While database 806 is illustrated as an internal component of the computer 802, in alternative implementations, database 806 can be external to the computer 802.

The computer 802 also includes a memory 807 that can hold data for the computer 802 or a combination of components connected to the network 830 (whether illustrated or not). Memory 807 can store any data consistent with the present disclosure. In some implementations, memory 807 can be a combination of two or more different types of memory (for example, a combination of semiconductor and magnetic storage) according to particular needs, desires, or particular implementations of the computer 802 and the described functionality. Although illustrated as a single memory 807 in FIG. 8, two or more memories 807 (of the same, different, or combination of types) can be used according to particular needs, desires, or particular implementations of the computer 802 and the described functionality. While memory 807 is illustrated as an internal component of the computer 802, in alternative implementations, memory 807 can be external to the computer 802.

An application can be an algorithmic software engine providing functionality according to particular needs, desires, or particular implementations of the computer 802 and the described functionality. For example, an application can serve as one or more components, modules, or applications. Multiple applications can be implemented on the computer 802. Each application can be internal or external to the computer 802.

The computer 802 can also include a power supply 814. The power supply 814 can include a rechargeable or non-rechargeable battery that can be configured to be either user- or non-user-replaceable. In some implementations, the power supply 814 can include power-conversion and management circuits, including recharging, standby, and power management functionalities. In some implementations, the power-supply 814 can include a power plug to allow the computer 802 to be plugged into a wall socket or a power source to, for example, power the computer 802 or recharge a rechargeable battery.

There can be any number of computers 802 associated with, or external to, a computer system including computer 802, with each computer 802 communicating over network 830. Further, the terms "client," "user," and other appropriate terminology can be used interchangeably, as appropriate, without departing from the scope of the present disclosure. Moreover, the present disclosure contemplates that many users can use one computer 802 and one user can use multiple computers 802.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, Linux, Unix, Windows, Mac OS, Android, or iOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

A number of implementations of the systems and methods have been described. Nevertheless, it will be understood that various modifications may be made without departing from the spirit and scope of this disclosure. Accordingly, other implementations are within the scope of the following claims.

What is claimed is:

1. A method for improving injectivity of a hydrocarbon reservoir, the method comprising:

identifying a restriction of flow from an injection well into the hydrocarbon reservoir;

transmitting a series of acoustic waves from the injection well into a formation that includes the hydrocarbon reservoir, wherein the series of acoustic waves are transmitted continuously for at least one day;

transmitting a series of seismic waves from the injection well into the formation after the series of acoustic waves are transmitted into the hydrocarbon reservoir, wherein the series of seismic waves are transmitted continuously for at least one week; and injecting water into the injection well to cause hydrocarbon of the hydrocarbon reservoir to flow from the hydrocarbon reservoir to a production well after the series of acoustic waves and the series of seismic waves are transmitted into the hydrocarbon reservoir.

2. The method of claim 1, further comprising varying a frequency of the acoustic waves during the transmission of the acoustic waves.

3. The method of claim 2, wherein the frequency of the acoustic waves is varied such that the frequency is greater than 20 kHz for a first duration of time and less than 20 kHz for a second duration of time.

4. The method of claim 2, wherein the frequency is dependent on a length scale of a heterogeneity of the formation.

5. The method of claim 2, wherein the frequency is dependent on a predicted distance of the restriction of flow from the injection well.

6. The method of claim 1, wherein the series of acoustic waves include an ultrasonic wave of frequency greater than 20 kHz.

7. The method of claim 1, further comprising varying a frequency of the seismic waves during the transmission of the seismic waves.

8. The method of claim 7, wherein the frequency is dependent on a length scale of a heterogeneity of the formation.

9. The method of claim 1, wherein the series of acoustic waves are transmitted continuously for between one day and one week.

10. The method of claim 1, wherein the series of seismic waves are transmitted continuously for between one and four weeks.

11. The method of claim 1, further comprising measuring an injectivity of the hydrocarbon reservoir at the production well after injecting the water.

12. The method of claim 1, wherein transmitting the series of acoustic waves includes transmitting a second series of acoustic waves into the formation and transmitting the series of seismic waves includes transmitting a second series of seismic waves into the formation.

13. The method of claim 12, wherein the second series of acoustic waves and the second series of seismic waves are transmitted from the injection well.

14. The method of claim 12, wherein the injection well is a first injection well and the second series of acoustic waves and the second series of seismic waves are transmitted from a second injection well into the formation.

15. A system for improving injectivity of a hydrocarbon reservoir, the system comprising:

a first vibration device within an injection well, the first vibration device operable to transmit a series of acoustic waves into a formation around the injection well to improve a flow rate into the formation from the injection well;

a second vibration device within the injection well, the second vibration device operable to transmit a series of seismic waves into the formation to improve the flow rate into the formation from the injection well;

a pump operable to inject water from the injection well into the formation; and a processor configured to control the first vibration device, the second vibration device, and the pump, the processor:

controlling the first vibration device and the second vibration device such that the first vibration device transmits the series of seismic waves after the second vibration device transmits ultrasonic waves;

controlling the first vibration device to transmit the series of acoustic waves continuously for at least one week; and controlling the second vibration device to transmit the series of seismic waves continuously for at least one day.

16. The system of claim 15, wherein the first vibration device is operable to vary a frequency of the acoustic waves during the transmission of the acoustic waves.

17. The system of claim 16, wherein the frequency of the acoustic waves is varied such that the frequency is greater than 20 kHz for a first duration of time and less than 20 kHz for a second duration of time.

18. The system of claim 15, wherein the series of acoustic waves include an ultrasonic wave of frequency greater than 20 kHz.

19. The system of claim 15, wherein the second vibration device is operable to vary a frequency of the seismic waves during the transmission of the seismic waves.

20. The system of claim 15, further comprising an injectivity device operable to measure an injectivity of the hydrocarbon reservoir at a production well after injecting the water.

* * * * *